US006530498B1

(12) United States Patent
Ovadia

(10) Patent No.: US 6,530,498 B1
(45) Date of Patent: Mar. 11, 2003

(54) JEWELRY CASE WITH INVISIBLE SPRING HINGE

(76) Inventor: Joseph Ovadia, 109 Long Hill Rd., Little Falls, NJ (US) 07424

( * ) Notice: Subject to any disclaimer, the term of this patent is extended or adjusted under 35 U.S.C. 154(b) by 71 days.

(21) Appl. No.: 09/759,000

(22) Filed: Jan. 12, 2001

(51) Int. Cl.[7] ..... B65D 43/14

(52) U.S. Cl. ..... 220/829; 16/286; 206/6.1; 220/845; 220/4.22

(58) Field of Search ..... 16/280, 286, 281; 206/566, 6.1; 220/4.21–4.23, 811–813, 827, 829, 836, 838, 845, 847; 132/294, 295

(56) References Cited

U.S. PATENT DOCUMENTS 946,263 A * 1/1910 Palmer ..... 220/4.22
2,464,524 A * 3/1949 Nathan ..... 220/829
2,583,350 A * 1/1952 Witzgall ..... 220/845
4,150,779 A * 4/1979 Hilbrands ..... 220/845
4,431,114 A * 2/1984 Kleinfeld ..... 220/836
4,452,373 A * 6/1984 Pearce et al. ..... 220/4.22
D400,708 S * 11/1998 Srinaul ..... D3/294
6,173,476 B1 * 1/2001 Daoud ..... 16/286

FOREIGN PATENT DOCUMENTS

WO 90/15215 * 12/1990 ..... 220/4.22

* cited by examiner

*Primary Examiner*—Lee Young
*Assistant Examiner*—Robin A. Hylton
(74) *Attorney, Agent, or Firm*—Richard M. Goldberg

(57) ABSTRACT

A jewelry case includes a base having a bottom wall and a peripheral side wall; a top cover having a top wall and a peripheral side wall; a first retainer in a slot of a rear wall of the top cover so as not to be visible from an exterior of the case when the case is closed; a second retainer in a slot of a rear wall of the base so as not be visible from an exterior of the case when the case is closed; and a C-clip which is not visible from an exterior of the case when the case is closed and which connects together the first and second retainers to provide a combined pivoting and sliding movement of a rear edge of the top cover on the base during opening and closing of the top cover.

15 Claims, 14 Drawing Sheets

FIG. 15
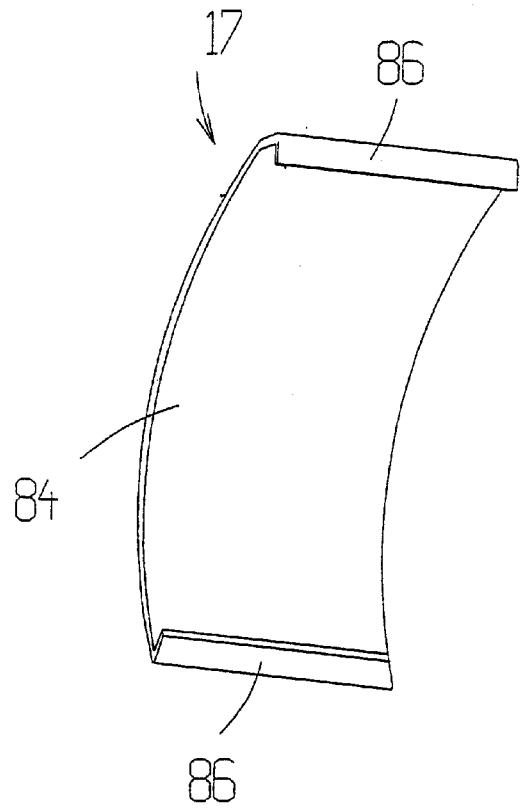
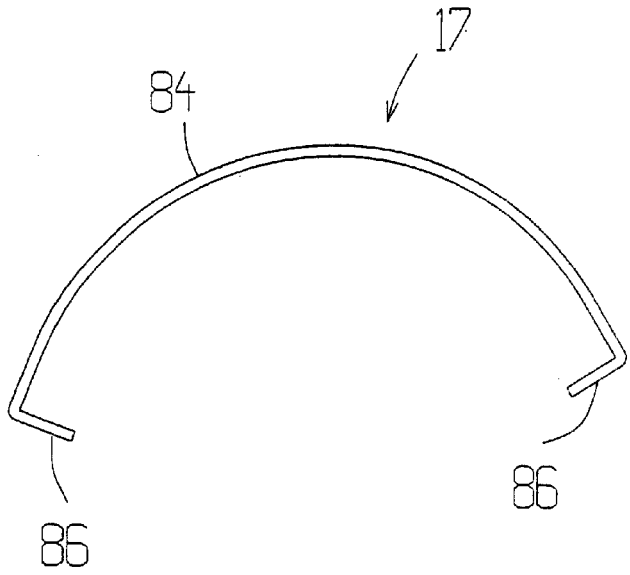
FIG. 16

JEWELRY CASE WITH INVISIBLE SPRING HINGE

BACKGROUND OF THE INVENTION

The present invention relates generally to display and storage devices, and more particularly, is directed to a jewelry case for storing and displaying jewelry items.

It is known to provide jewelry cases with spring hinges which cause automatic closing of the case when the cover is partially closed to a certain extent. However, the hinges are arranged so that the pivot axis is fixed at all times during the closing and opening operations. In the majority of the cases, the hinges are provided to the outside of the case, that is, the hinges are visible from the outside, which detracts from the aesthetics of the case.

In other cases, a C-clip spring hinge is provided to the inside of the case. However, such C-clip spring hinges have only been used with plastic cases that have thin walls, with the inner surfaces of the thin walls cut away to hold the ends of the C-clip spring. It is not possible, however, to use thin walls made of wood that could be cut away to hold the C-clip spring, since the wood will fail over time. If the thickness of the wood walls were increased in order to hold the C-clip spring, then the outer surfaces of the rear walls of the upper and lower halves would have to be cut away, or spaced from each other, to enable pivoting of the two halves along the fixed pivot axis. Such cut-away portions must even be provided for a thin wall to enable pivoting around a fixed pivot axis. This, however, detracts from the appearance of the case. The same results would apply with walls made of plastic, metal, etc. Also, a groove is provided on the upper surface of the rear wall of one half and a lip is provided on the upper surface of the rear wall of the other half for engagement within the groove. This ensures that there is no sliding movement between the halves so that the two halves pivot relative to each other about a fixed pivot axis.

OBJECTS AND SUMMARY OF THE INVENTION

Accordingly, it is an object of the present invention to provide a jewelry case that overcomes the problems with the aforementioned prior art.

It is another object of the present invention to provide a jewelry case in which the hinge is not visible from the exterior of the case.

It is still another object of the present invention to provide such a jewelry case in which the pivot axis of the hinge moves linearly during the opening and closing of the case.

It is yet another object of the present invention to provide a jewelry case in which the hinge also functions to move the rear pivoting edge of the top cover inwardly during a closing operation so as to provide a sliding action as well as a pivoting or rolling action.

It is a further object of the present invention to provide a jewelry case having a hinge that functions to automatically force the top cover into an open position during an opening operation and into a closed position during a closing operation after the top cover has pivoted to a predetermined angle relative to the base.

In accordance with an aspect of the present invention, a case includes a base including a bottom wall and a peripheral side wall connected to the bottom wall; a top cover including a top wall and a peripheral side wall connected to the top wall such that a cavity is defined between the top wall and the peripheral side wall of the top cover and the bottom wall and the peripheral side wall of the base when the case is in a closed condition; and a spring hinge which is not visible from an exterior of the case when the case is closed and which connects together the base and the top cover in such a manner so as to provide a combined pivoting movement and sliding movement of a rear edge of one of the top cover and the base on the other of the top cover and the base during opening and closing of the case.

The spring hinge includes a first retainer connected with said one of the top cover and the base; a second retainer connected with the other of the top cover and the base; and a C-clip having a first end connected with the first retainer and a second end connected with the second retainer.

The first retainer is integrally formed as a one-piece structure with said one of the top cover and the base, and the second retainer is integrally formed as a one-piece structure with the other of the top cover and the base.

The first retainer has a first height and the second retainer has a second height, with the second height being less than the first height. Accordingly, the rear edge of said one of the top cover and the base moves forwardly in the sliding movement on the other of the top cover and the base during opening of the case and moves rearwardly in the sliding movement on the other of the top cover and the base during closing of the case.

The first retainer has a first thickness at a position where the C-clip attaches thereto and the second retainer has a second thickness at a portion where the C-clip attaches thereto, the second thickness being greater than the first thickness, so that said one of the top cover and base slides and pivots on the other of the top cover and the base.

In another embodiment, the first retainer has a first height and the second retainer has a second height, with the first and second heights being substantially equal.

The peripheral side wall of the top cover includes a lower exposed surface and a rear portion with a first slot extending in the rear portion through the lower exposed surface. In like manner, the peripheral side wall of the base includes an upper exposed surface and a rear portion with a second slot extending in the rear portion through the upper exposed surface. The first retainer is mounted in one of the first and second slots, and the second retainer is mounted in the other of the first and second slots. The second retainer includes at least one stop that extends above the upper surface of the other of the top cover and the base for limiting forward sliding movement of said one of the top cover and the base on the other of the top cover and the base during opening of the case. In like manner, the first retainer includes an extending section that extends beyond the exposed surface of said one of the top cover and the base, and the extending section extends into the second slot in the other of the top cover and the base when the case is closed and the at least one stop extends into the first slot in said one of the top cover and the base when the case is closed.

In addition, the rear portion of the top cover includes an opening in an inner surface thereof which provides communication between the cavity and the respective one of the first and second slots, and the base includes an opening in an inner surface thereof which provides communication between the cavity and the other one of the first and second slots.

The retainer includes a central section and first and second end sections connected at opposite ends of the central section, the central section of the first retainer has a first height and the central section of the second retainer has a second height, with the first and second heights being different and the C-clip being connected between the central sections of the first and second retainers such that the rear edge of said one of the top cover and the base connected with the retainer having a greater height moves forwardly in the sliding movement on the other of the top cover and the base during opening of the case and moves rearwardly in the sliding movement on the base during closing of the case.

In another embodiment, each retainer includes a central section and first and second end sections connected at opposite ends of said central section, the central section of the first retainer has a first height and the central section of the second retainer has a second height, with the first and second heights being substantially equal and the C-clip being connected between the central sections of the first and second retainers.

Preferably, the C-clip has an arcuate shape with inturned ends for engaging the first and second retainers.

Preferably, the first retainer is connected with the top cover and the second retainer is connected with the base. In such case, the first retainer has a first height and a first thickness at a position where the C-clip attaches thereto, the second retainer has a second height and a second thickness at a portion where the C-clip attaches thereto, and at least one of the following conditions exists so that the top cover pivots and slides on the base during opening and closing operations of the case: the second height is less than said first height, and/or the second thickness is greater than the first thickness.

The above and other objects, features and advantages of the invention will become readily apparent from the following detailed description thereof which is to be read in connection with the accompanying drawings.

BRIEF DESCRIPTION OF THE DRAWINGS

FIG. 15 is a perspective view of the C-clip; and

FIG. 16 is a side elevational view of the C-clip.

DETAILED DESCRIPTION

Figure 1:
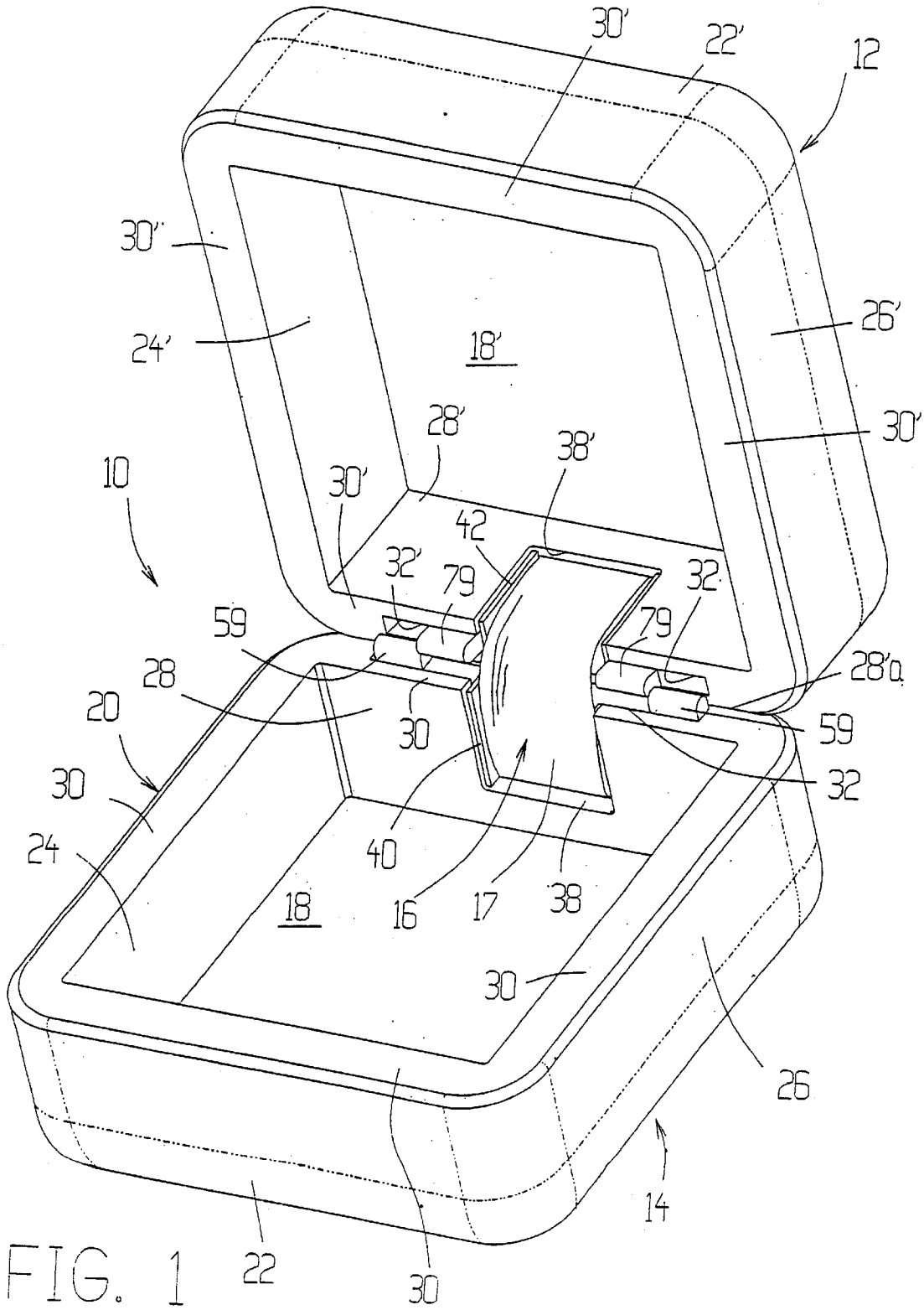
FIG. 1 is a perspective view of a jewelry case in an open condition, according to the present invention.

Referring to the drawings in detail, and initially to FIG. 1 thereof, a jewelry case 10 according to the present invention includes a top cover 12 and a base 14 hinged together by a spring hinge 16 which is not visible from the exterior of case 10. Spring hinge 16 functions to automatically force top cover 12 into an open position during an opening operation and into a closed position during a closing operation after top cover 12 has pivoted a predetermined angle relative to base 14. Top cover 12 and base 14 have an essentially identical configuration. Therefore, the structure of base 14 will be discussed, with the understanding that this description also applies to top cover 12, and the same elements of top cover 12 are denoted by a prime (') after the number.

Figure 2:
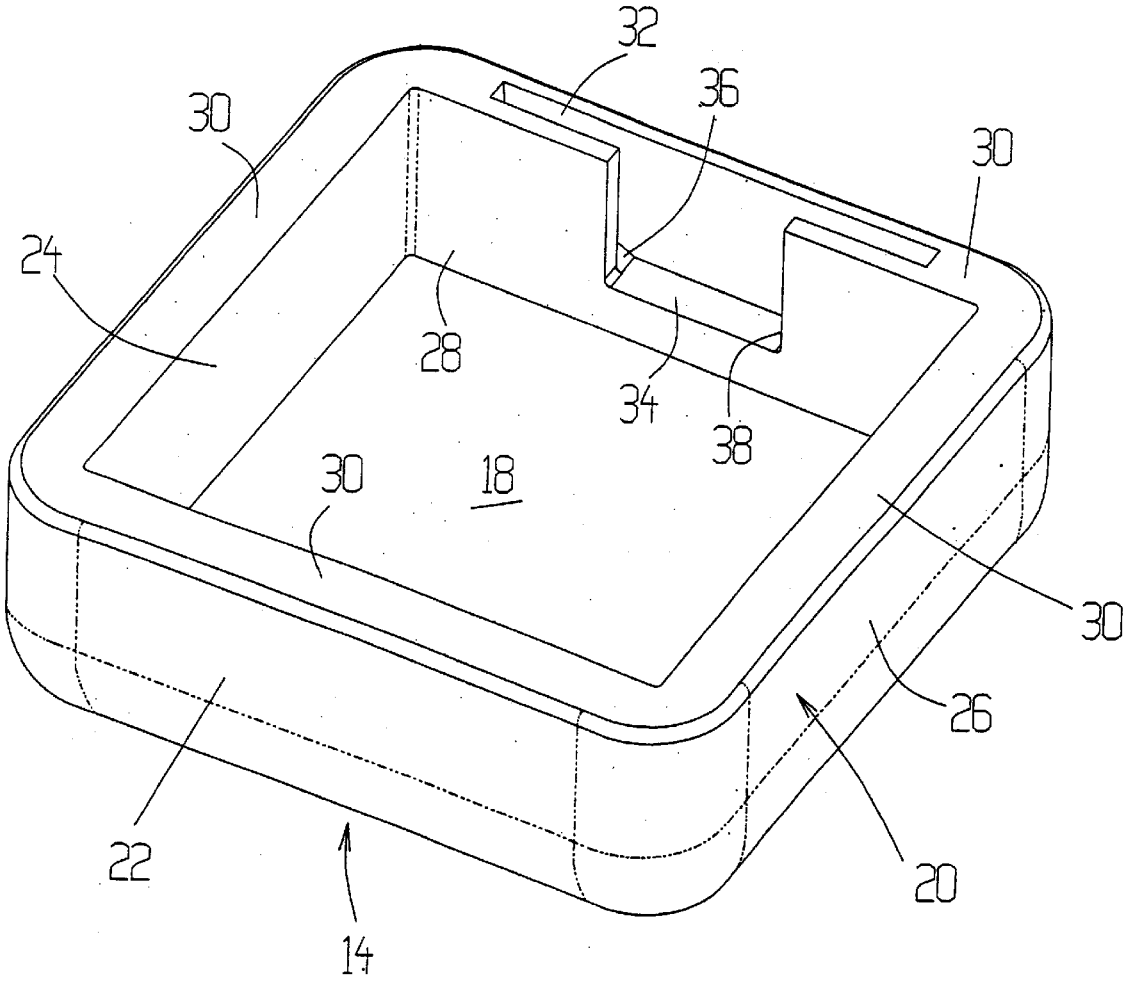
FIG. 2 is a perspective view of the base of the jewelry case, with the top cover being substantially identical.
Figure 3:
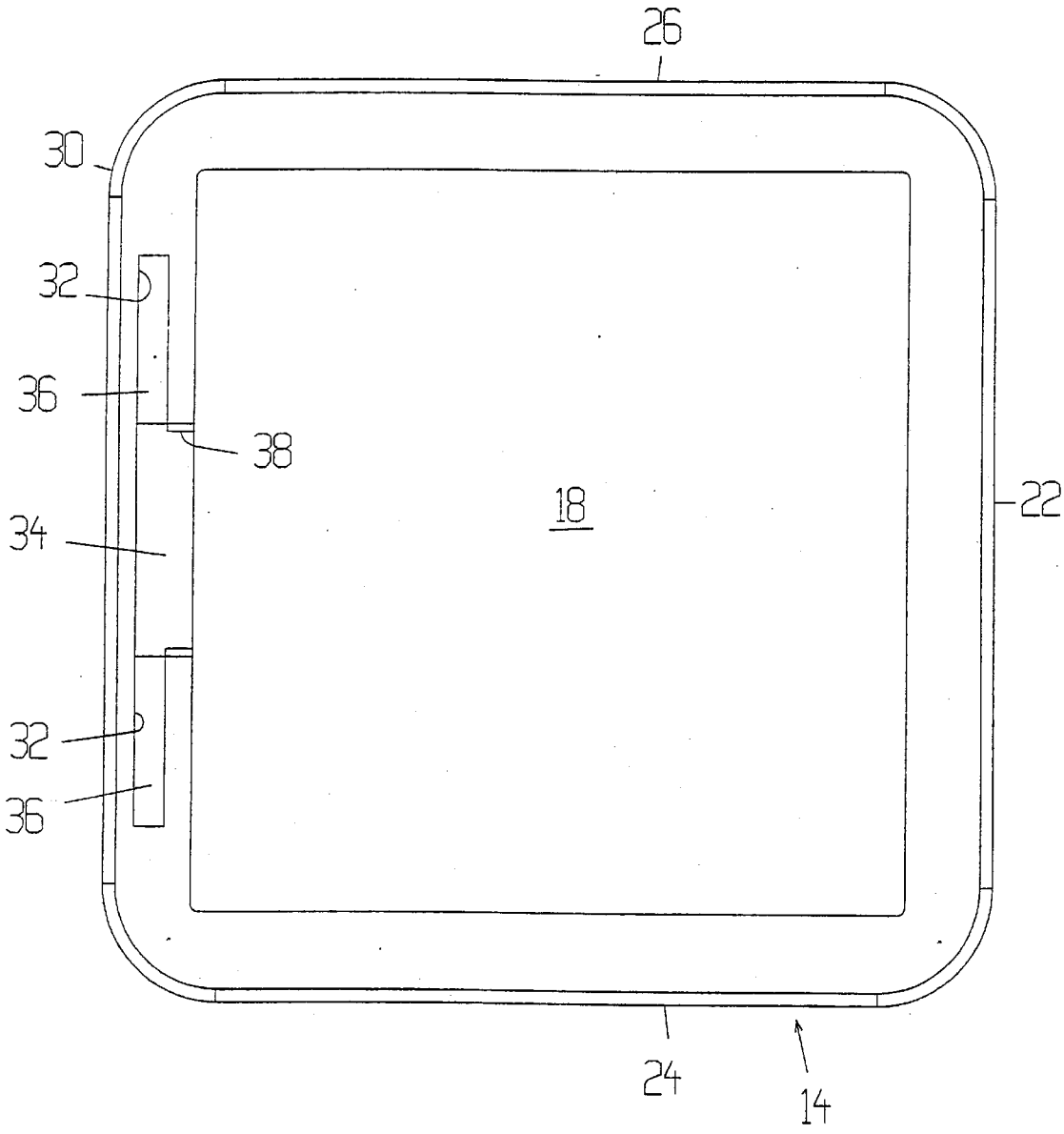
FIG. 3 is a top plan view of the base.
Figure 5:
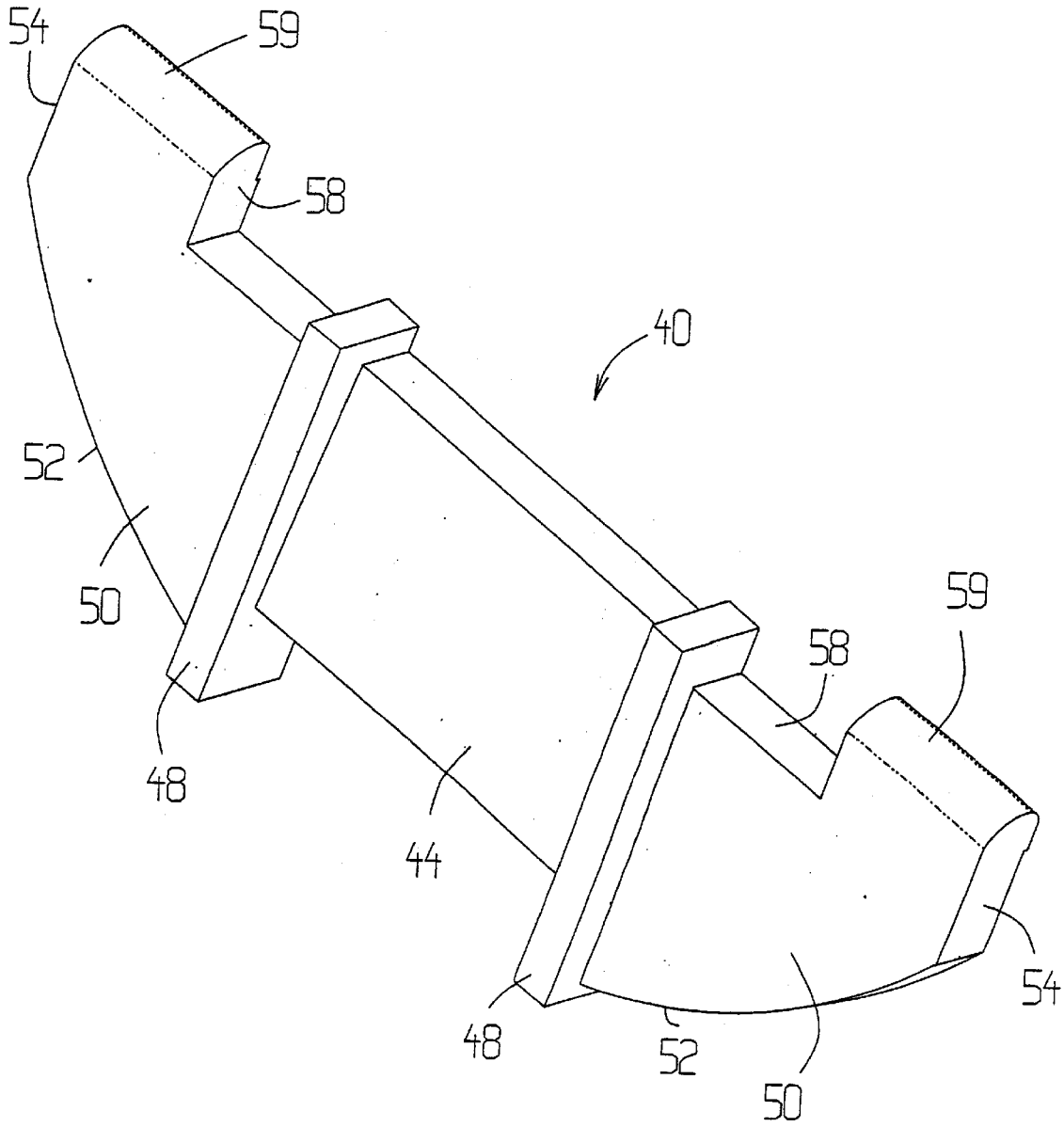
FIG. 5 is a perspective view of a first retainer to be mounted to the base, viewed from a top, front thereof.
Figure 6:
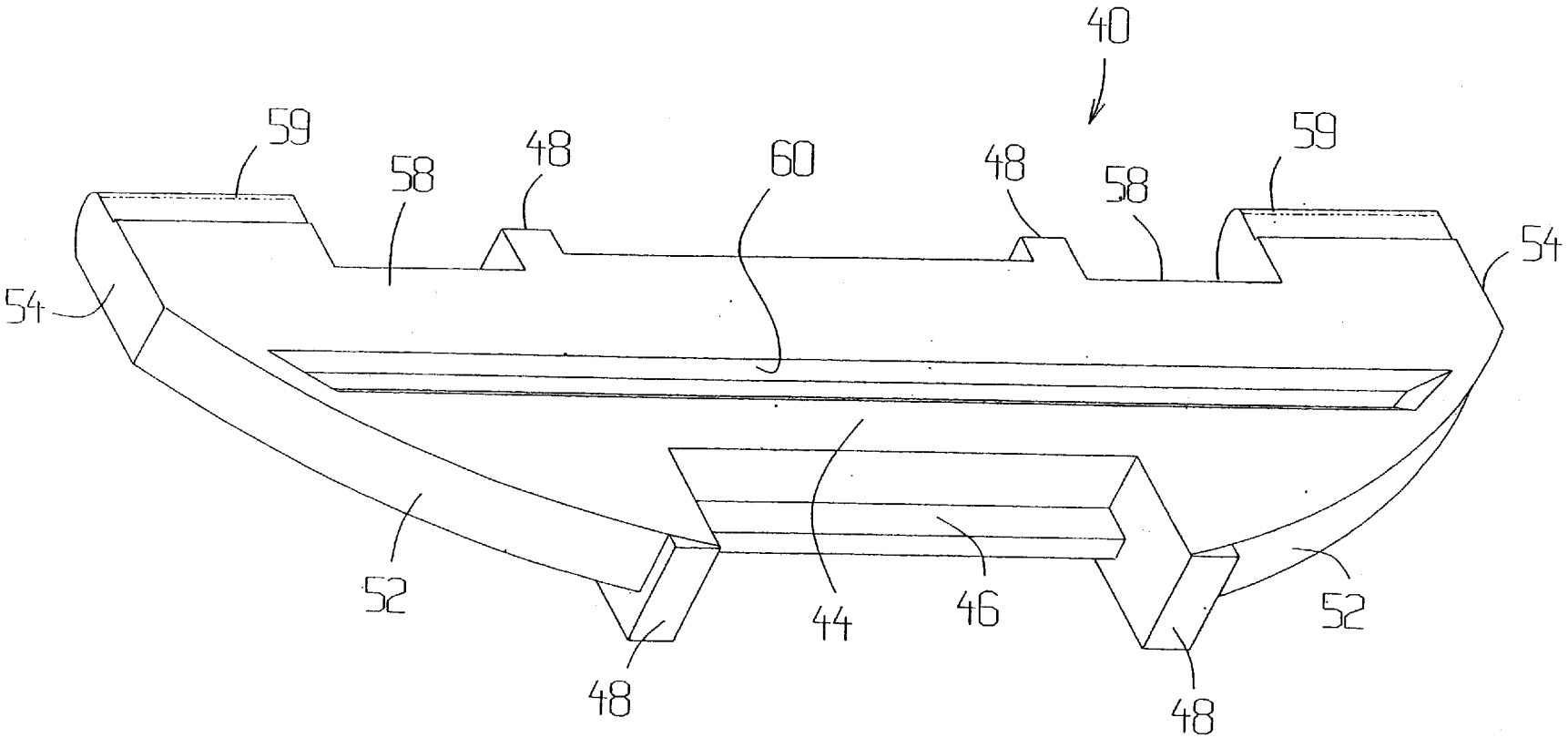
FIG. 6 is a perspective view of the first retainer, viewed from a bottom, rear thereof.
Figure 7:
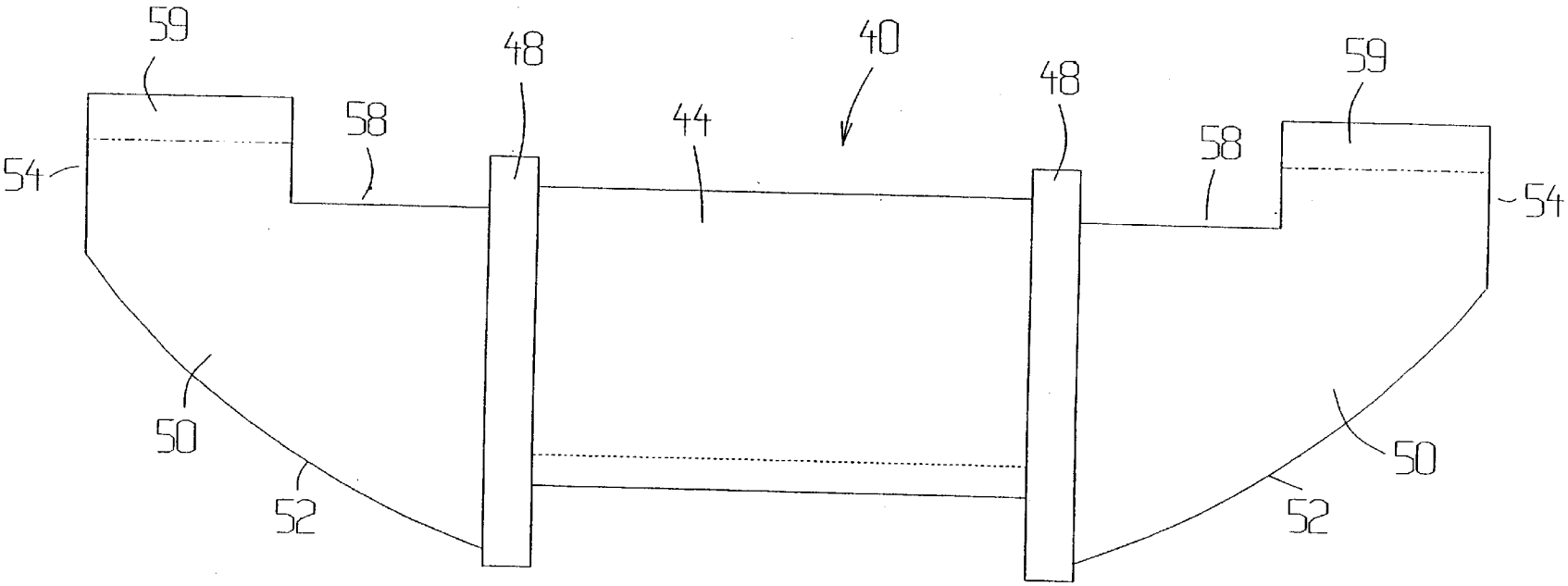
FIG. 7 is a front elevational view of the first retainer.
Figure 8:
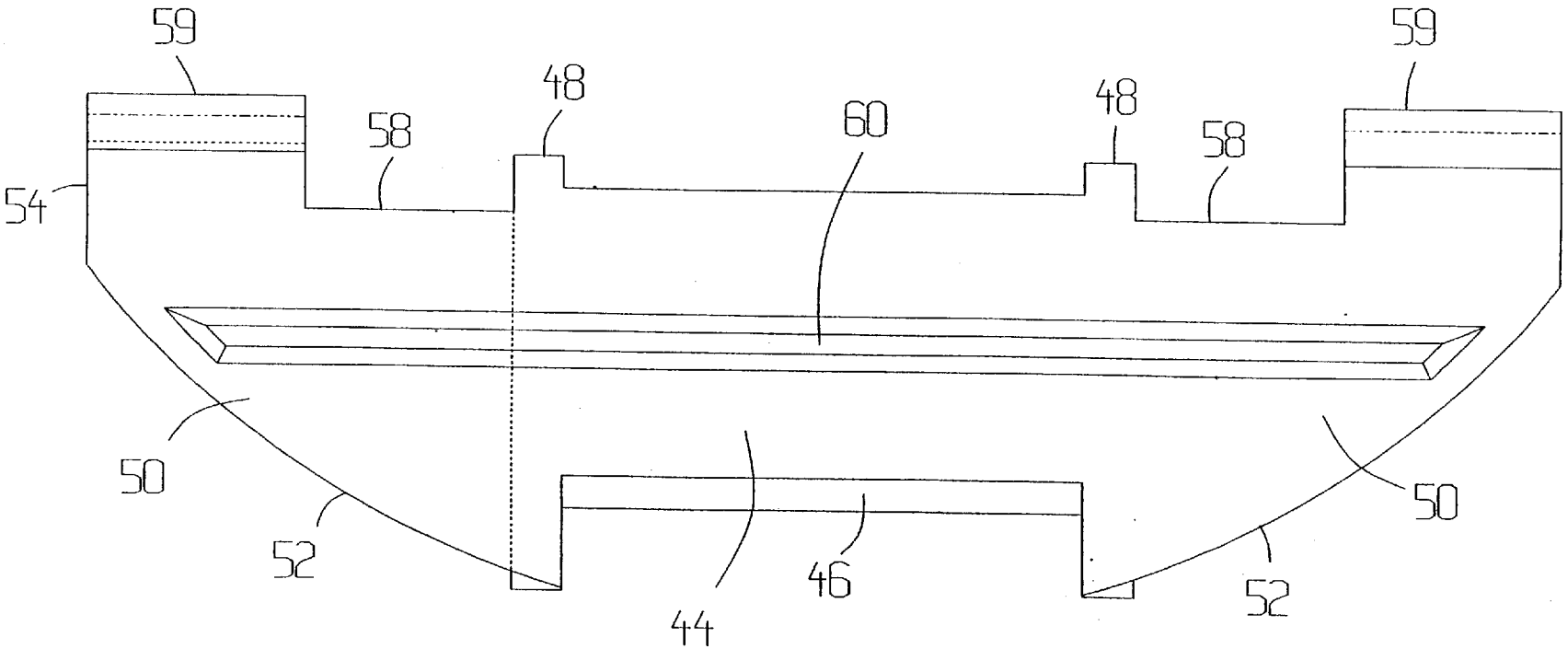
FIG. 8 is a rear elevational view of the first retainer.
Figure 9:
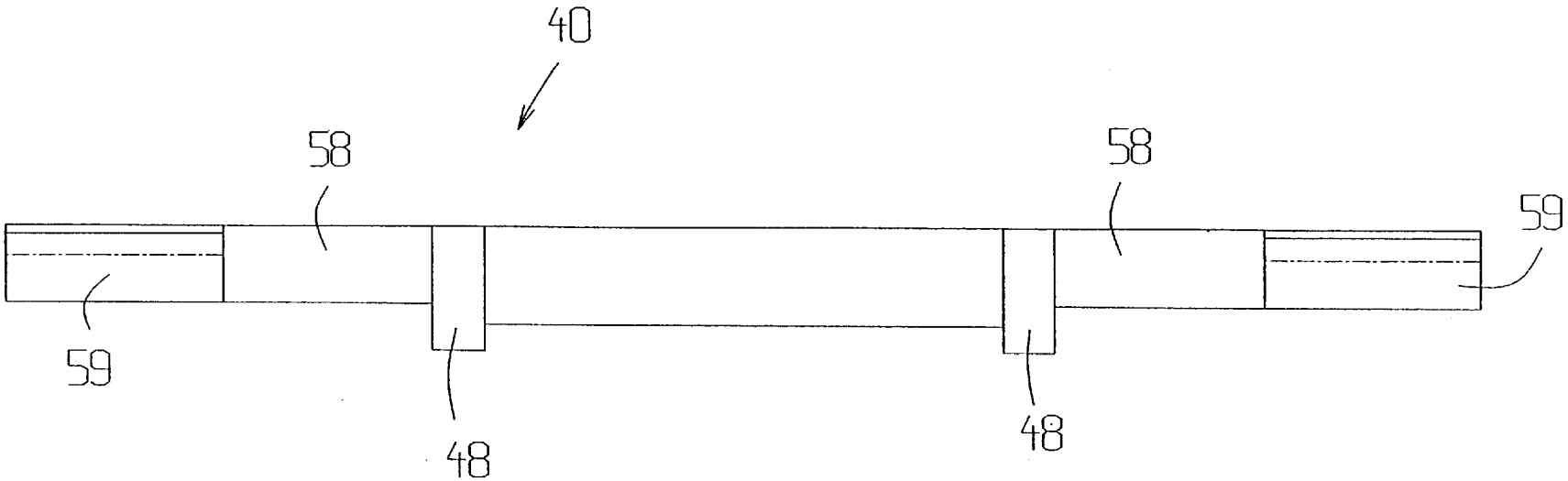
FIG. 9 is a top plan view of the first retainer.
Figure 10:
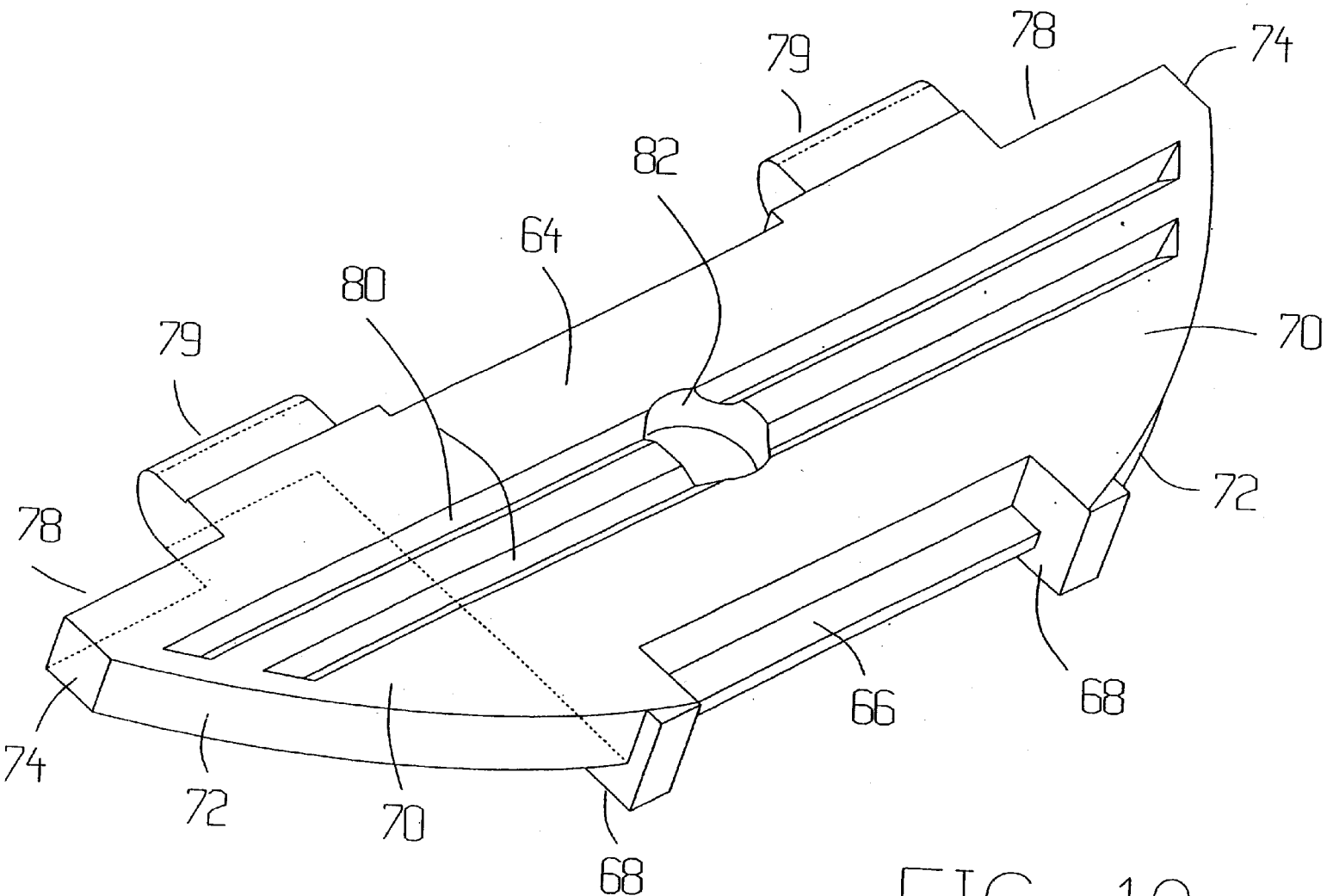
FIG. 10 is a perspective view of the second retainer to be mounted to the top cover, viewed from a bottom, rear thereof.
Figure 11:
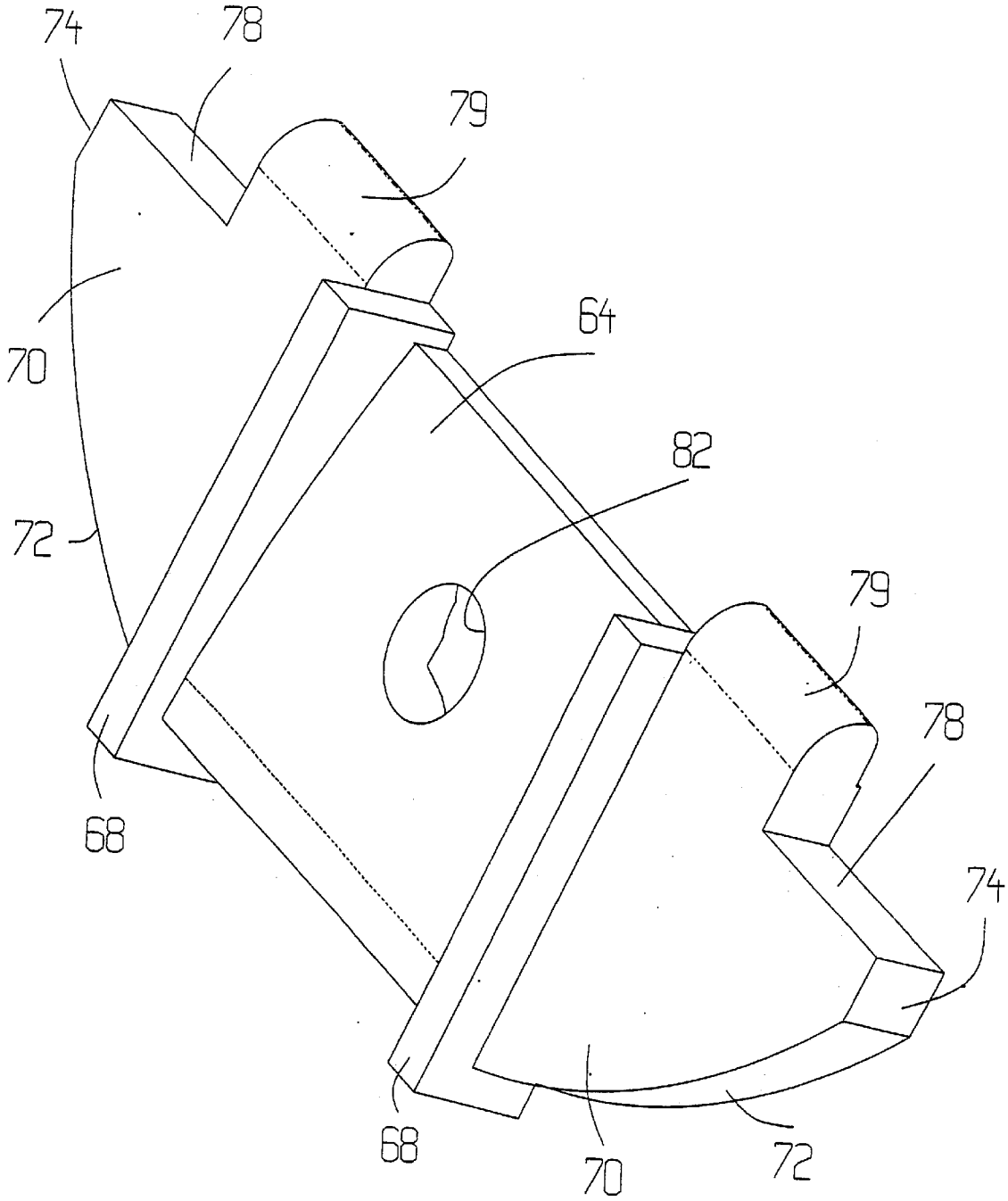
FIG. 11 is a perspective view of the second retainer, viewed from a top, front thereof.
Figure 12:
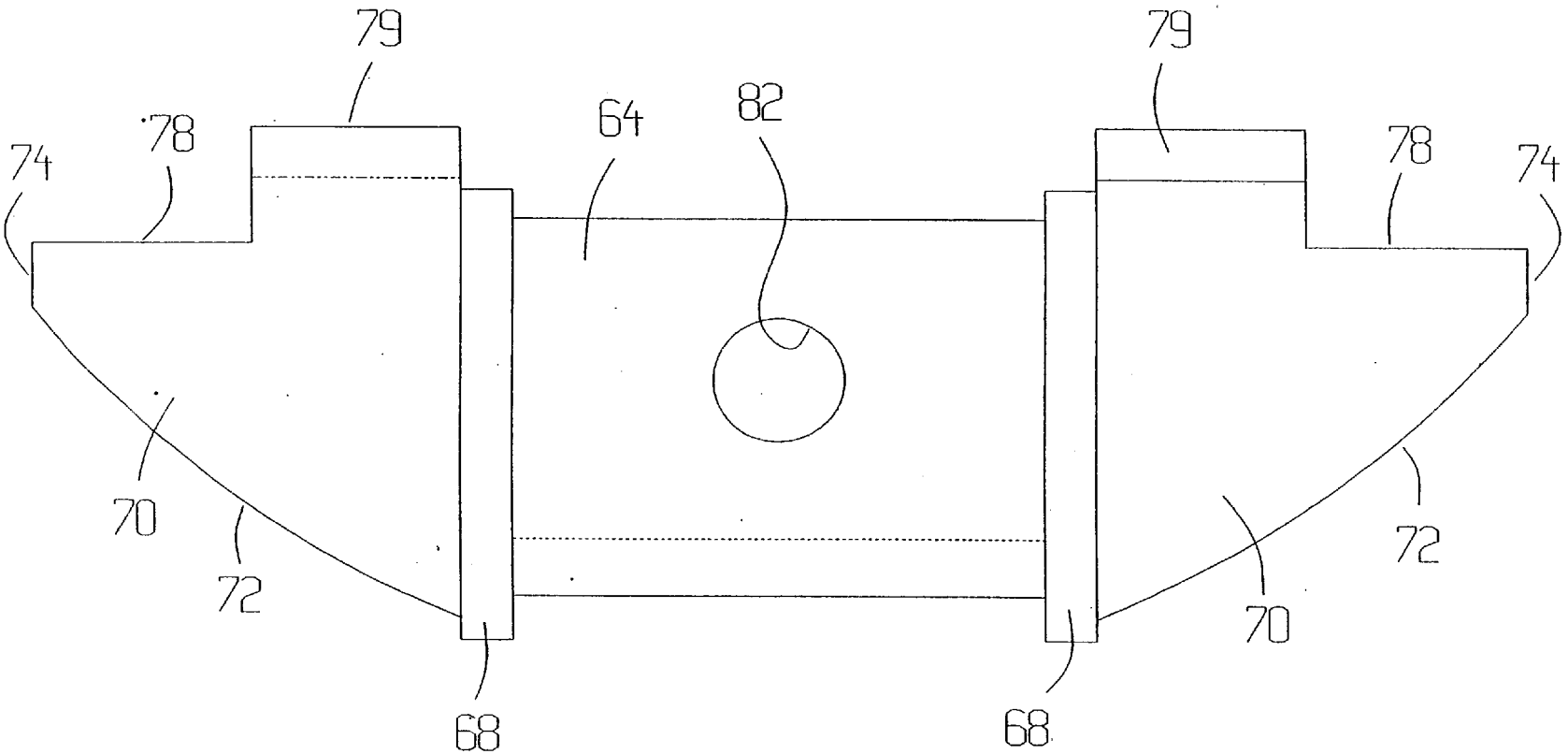
FIG. 12 is a front elevational view of the second retainer.
Figure 13:
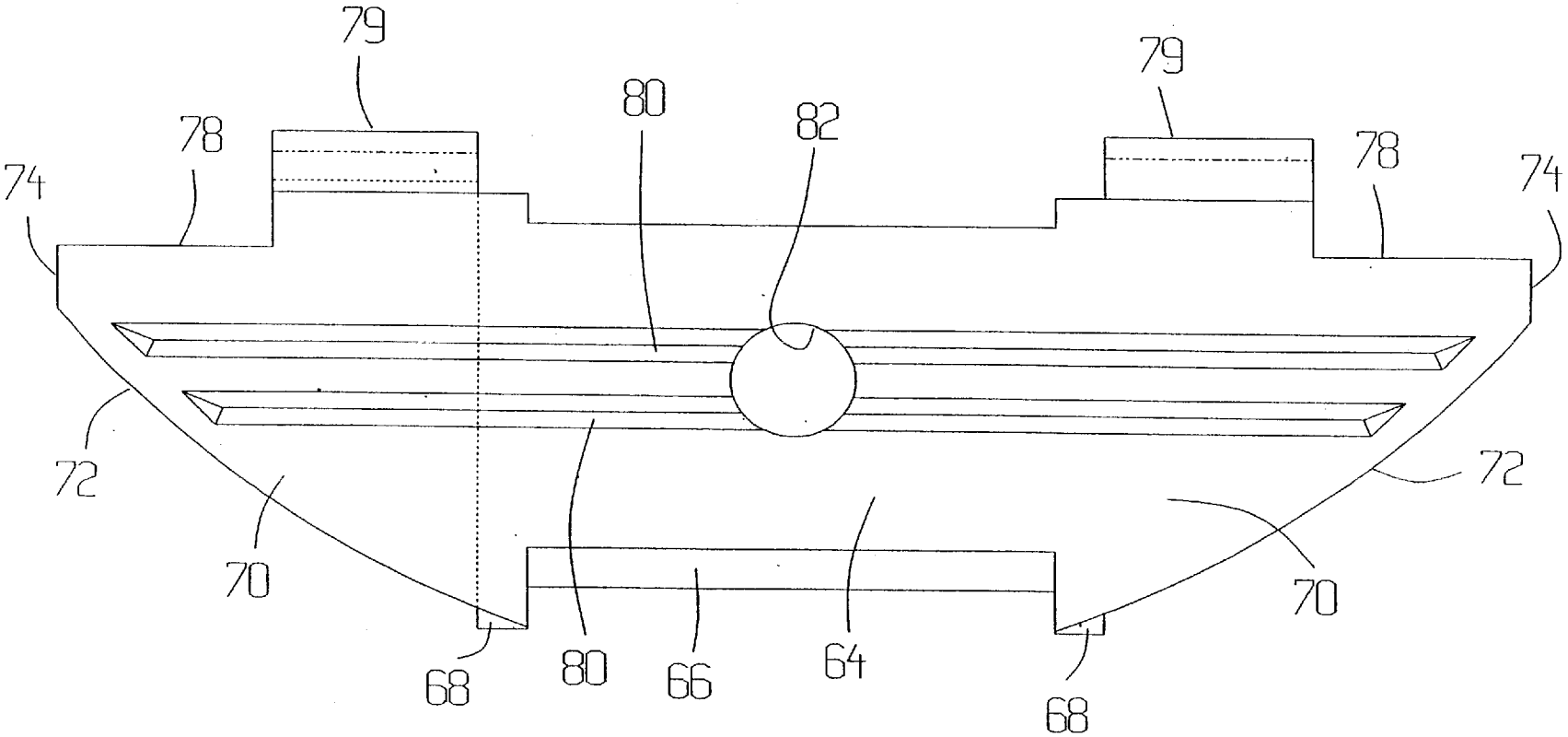
FIG. 13 is a rear elevational view of the second retainer.
Figure 14:
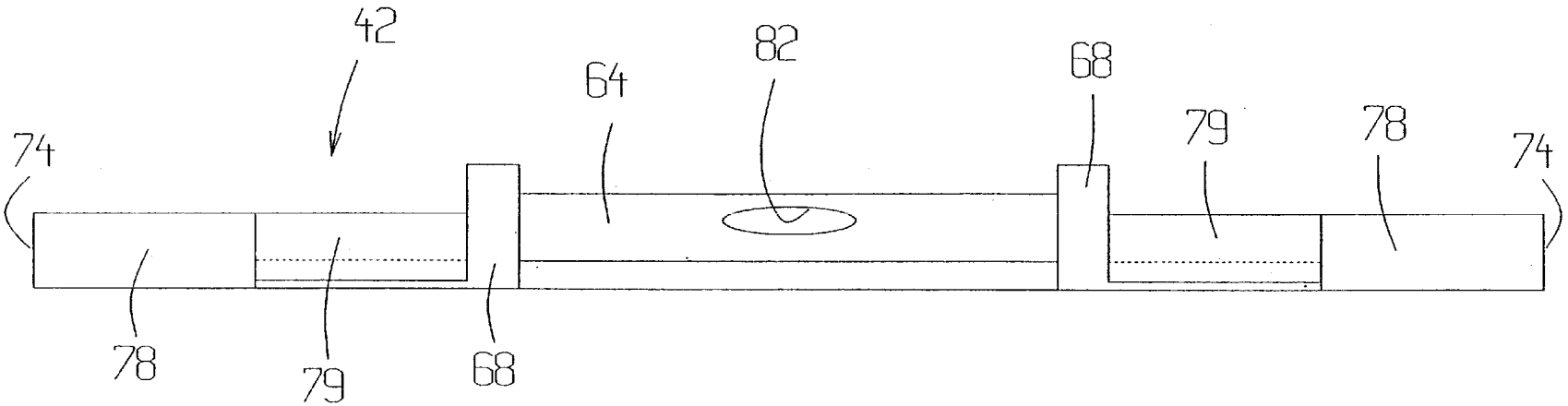
FIG. 14 is a top plan view of the second retainer.

As best shown in FIGS. 1–3, base 14 is in the form of a shell half and includes a bottom wall 18 and an upstanding peripheral side wall 20 extending upwardly therefrom, and specifically, a front wall 22, side walls 24 and 26 and rear wall 28 that form an essentially square configuration, although the present invention is not limited to this number of walls or this configuration. A cavity is defined between bottom wall 18 and peripheral walls 22, 24, 26 and 28. The outer surface of peripheral side wall 20 at the corners where walls 22, 24, 26 and 28 meet are preferably rounded, although the present invention is not limited thereto. The upper surfaces 30 of walls 22, 24, 26 and 28 are preferably coplanar, and the upper end of base 14 is open. Top cover 12 in like manner includes a top wall 18' and peripheral walls 22', 24', 26' and 28' forming an upstanding peripheral side wall 20' with lower coplanar surfaces 30'.

A slot 32 is formed in rear wall 28, and extends between the exterior and interior surfaces of rear wall 28. Slot 32 extends almost the entire length of rear wall 28. Preferably, the lower surface of slot 32 includes a central flat portion 34 which leads into upwardly curved portions 36 at opposite sides thereof. A central rectangular opening 38 is provided at the interior surface of rear wall 28, and has a side to side dimension substantially equal to the length of central flat portion 34 so as to be coextensive therewith. Thus, opening 38 provides open communication between slot 32 and the interior cavity of base 14. In like manner, a slot 32' of identical shape and size to slot 32 is formed in rear wall 28', and extends between the exterior and interior surfaces of rear wall 28'. Also, a central rectangular opening 38' is provided at the interior surface of rear wall 28' and provides open communication between slot 32' and the interior cavity of top cover 12.

In order to connect top cover 12 and base 14, spring hinge 16 includes a first retainer 40 mounted within slot 32 and opening 38 of base 14 and a second retainer 42 mounted within slot 32' and opening 38' of top cover 12, with a C-clip 17 having a first end connected to first retainer 40 and a second opposite end connected to second retainer 42. First retainer 40, second retainer 42 and C-clip 17 together form spring hinge 16 which connects together top cover 12 and base 14 in such a manner so as to provide a combined pivoting movement and sliding or linear movement of top cover 12 relative to base 14 during opening and closing of top cover 12.

Referring now to FIGS. 1 and 5–9, first retainer 40 is fixedly positioned in slot 32 and opening 38 of base 14 by a friction fit and/or is secured therein by an adhesive. First retainer 40 includes a planar rectangular central wall 44 having an undercut 46 at the lower end of the rear side. Two vertically extending flanges 48 extend slightly forwardly from opposite sides of wall 44 so that when first retainer 40 is inserted within slot 32, flanges 48 fit snugly within opening 38 of base 14.

Two generally quarter arcuate end sections 50 are provided, one on each side of central wall 44 and flanges 48, and integrally connected thereto as a one-piece structure. Thus, each arcuate section 50 includes a lower surface 52 that curves upwardly toward the outer ends, and which leads into a flattened or planar end wall 54. Curved lower surfaces 52 have a curvature similar to the curvature of upwardly curved portions 36 so as to rest thereon when first retainer 40 is inserted within slot 32. The distance between planar end walls 54 is similar to the length of slot 32 in base 14 so that first retainer 40 fits snugly therein. It will be appreciated that the present invention is not limited to the particular shape of first retainer 40 that is shown. Further, for larger jewelry boxes, two or more slots 32 and corresponding openings 38 can be provided, with a first retainer 40 in each slot 32 and corresponding opening 38.

It is an important aspect of the present invention that the upper ends of arcuate sections 50 extend above upper surface 30 of rear wall 28 when first retainer 40 is inserted within slot 32 in base 14. In this regard, in the closed condition of jewelry case 10, the upper ends of arcuate sections 50 which extend above upper surface 30 of rear wall 28, extend into slot 32' in top cover 12. Further, each arcuate section 50 includes an upper cut-away section 58 which extends from the respective flange 48 to approximately one-half of the distance to the respective end wall 54, with cut-away sections 58 extending below upper surface 30 of rear wall 28 when first retainer 40 is inserted within slot 32 in base 14. The present invention is not limited to this distance, so that the length of cut-away sections 58 can vary. The portions of the upper ends of arcuate sections 50 which extend above upper surface 30 of rear wall 28, thereby form stops 59, as will be understood from the discussion hereafter. It will be appreciated that more than two stops 59 can be provided.

It is also noted that the rear surfaces of central wall 44 and quarter arcuate sections 50 are coplanar and together form a continuous rear wall of first retainer 40. At least one recess or groove 60 extends lengthwise of this continuous rear wall, as shown best in FIG. 6, although the present invention does not require groove 60. Adhesive can be placed in groove 60 for adhering first retainer 40 in slot 32 of base 14.

Referring now to FIGS. 1 and 10–14, second retainer 42 is fixedly positioned in slot 32' and opening 38' of top cover 12 by a friction fit or secured by an adhesive. Second retainer 42 includes a rectangular central wall 64 which generally tapers in thickness from a lower end to an upper end thereof, and which has an undercut 66 at the lower end of the rear side. Preferably, the thickness of central wall 64 is less than the thickness at the upper end of central wall 44, the reasons for which will become apparent from the discussion hereinafter. Two vertically extending flanges 68 extend slightly forwardly from opposite sides of wall 64 so that when second retainer 42 is inserted within slot 32', flanges 68 fit snugly within opening 38' of top cover 12.

Two generally quarter arcuate end sections 70 are provided, one on each side of central wall 64 and flanges 68, and integrally connected thereto as a one-piece structure. Thus, each arcuate section 70 includes a lower surface 72 that curves upwardly toward the outer ends, and which leads into a flattened or planar end wall 74. Curved lower surfaces 72 have a curvature similar to the curvature of the upwardly curved portions of top cover 12 so as to rest thereon when second retainer 42 is inserted within slot 32'. The distance between planar end walls 74 is similar to the length of slot 32' in top cover 12 so that second retainer 42 fits snugly therein. It will be appreciated that the present invention is not limited to the particular shape of second retainer 42 that is shown. Further, for larger jewelry boxes, two or more slots 32' and corresponding openings 38' can be provided, with a second retainer 42 in each slot 32' and corresponding opening 38'.

Upper ends of arcuate sections 70 extend above upper surface 30' of rear wall 28' when second retainer 42 is inserted within slot 32' in top cover 12. In this regard, in the closed condition of jewelry case 10, the upper ends 79 of arcuate sections 70 which extend above upper surface 30' of rear wall 28', extend into slot 32 in base 14 in opposition to upper cut-away sections 58. Further, each arcuate section 70 includes an upper cut-away section 78 which extends from the respective end wall 74 to approximately one-half of the distance to the respective flange 48, with cut-away sections 78 extending below upper surface 30' of rear wall 28' when second retainer 42 is inserted within slot 32' in top cover 12. The present invention is not limited to this distance, so that the length of cut-away sections 78 can vary. In the closed condition, the upper ends 79 of arcuate sections 50 which extend above upper surface 30 of rear wall 28 of base 14, extend into slot 32' in top cover 12 in opposition to upper cut-away sections 78. It will be appreciated that more than two upper ends 79 can be provided.

It is also noted that the rear surfaces of central wall 64 and quarter arcuate sections 70 are coplanar and together form a continuous rear wall of second retainer 42. At least one recess or groove 80 extends lengthwise of this continuous rear wall, as shown best in FIG. 10, although the present invention does not require groove 80. Adhesive can be placed in groove 80 for adhering second retainer 42 in slot 32' of top cover 12. For this same purpose, a central opening 82 can be provided in central wall 64, that is, to receive adhesive therein, although the present invention does not require central opening 82.

Referring now to FIGS. 1, 15 and 16, C-clip 17 is a metal or plastic leaf spring, for example, made of spring steel, stainless steel, etc., and having a thin arcuate main body 84 which terminates in inwardly turned lips 86 at the opposite ends thereof. One inwardly turned lip 86 grasps the lower end of central wall 44 of first retainer 40, while the other inwardly turned lip 86 grasps the upper end of central wall 64 of second retainer 42.

In accordance with an important aspect of the present invention, the height of central wall 44 of first retainer 40 is preferably less than the height of central wall 64 of second retainer 42 by a small amount. For example, while the height of central wall 44 can be 9 mm, the height of central wall 64 can be 11 mm. This is important for providing control of the combined rolling or pivoting movement of top cover 12 relative to base 14, and the forward sliding or linear movement of top cover 12 relative to base 14 when closing top cover 12. Of course, as will be appreciated, central wall 44 can have a greater height than central wall 64. In such case, there will be a pivoting and sliding movement of base 14 on top cover 12. It is preferred that the heights be different to control whether the rear edge of top cover 12 slides on upper surface 30 of base 14 or whether the rear edge of base 14 slides on upper surface 30' of top cover 12. Of course, it is still possible within the context of the present invention to make the heights of central walls 44 and 64 equal. However, in such case, which half slides on the other can change for each opening and closing operation.

Figure 4:
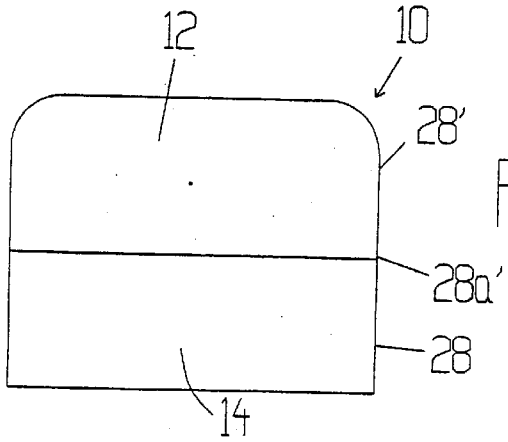
FIG. 4 is a side elevational view of the jewelry case in a fully closed condition.

As shown in FIG. 4, when jewelry case 10 is closed, the peripheral edges of top cover 12 and base 14 are substantially coincident, that is, in perfect alignment with each other. As top cover 12 is opened, the force of C-clip 17 tends to oppose the opening force until top cover 12 reaches a predetermined angle, which is preferably about 30 degrees. At this point, the rear edge 28*a*' of rear wall 28' of top cover 12 pivots relative to base 14. Rear edge 28*a'* pivots on upper surface 30 of rear wall 28 of base 14. However, in addition to this pivoting action, C-clip 17 pulls rear edge 28*a*' inwardly of base 14 until top surface 30' of rear wall 28' of top cover 12 abuts against stops 59, thereby also providing a sliding or linear movement of top cover 12 relative to base 14. This is a result of the different heights of central walls 44 and 64 and the different thicknesses at the engaged portions of central walls 44 and 64. Because of the different thicknesses, during an opening operation, C-clip 17 will first hit against thicker central wall 44 which will cause top cover 12 to be pulled inwardly. Therefore, both the heights and thicknesses together are factors in the sliding movement, although the height or thickness alone can be used and will each individually accomplish the same result.

In like manner, when closing jewelry case 10, as top cover 12 is closed, the force of C-clip 17 tends to oppose the closing force until top cover 12 reaches a predetermined angle, which is preferably about 30 degrees. At this point, the rear edge 28*a*' of rear section 28' of top cover 12 functions as a pivot axis about which top cover 12 pivots relative to base 14. Rear edge 28*a*' pivots on upper surface 30 of rear wall 28 of base 14. However, in addition to this pivoting movement, C-clip 17 pushes rear edge 28*a*' outwardly of base 14 until top surface 30' of rear section 28' of top cover 12 and top surface 30 of rear section 28 of base 14 are in alignment, as shown in FIG. 4. Accordingly, a reverse sliding or linear movement is provided again, in addition to the pivoting movement.

The present invention thereby provides a jewelry case 10 in which the spring hinge is not visible from the exterior of case 10. In order to accomplish this result, the pivot axis moves or slides during the opening and closing of the case. Specifically, spring hinge 16 also functions to move the rear pivoting edge 28*a*' of top cover 12 inwardly during a closing operation so as to provide a sliding action as well as a pivoting or rolling action. Further, spring hinge 16 has the function to automatically force top cover 12 into an open position during an opening operation and into a closed position during a closing operation after top cover 12 has pivoted a predetermined angle relative to base 14.

It will be appreciated that, while the present invention has been discussed in relation to a jewelry case, the present invention is not limited thereby, and the present invention can be used with any case, regardless of the application.

Further, base 14 and first retainer 40 can be integrally molded as a one-piece plastic member, and top cover 12 and second retainer 42 can be integrally molded as a one-piece plastic member.

Alternatively, retainers 40 and 42 can be secured by any suitable means to base 14 and top cover 12, for example, by adhesives, welding, crimping, snap fit, etc.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. A case comprising:

a base including a bottom wall and a peripheral side wall connected to the bottom wall;

a top cover including a top wall and a peripheral side wall connected to the top wall such that a cavity is defined between the top wall and the peripheral side wall of the top cover and the bottom wall and the peripheral side wall of the base when the case is in a closed condition; and a spring hinge which is not visible from an exterior of the case when the case is closed and which connects together the base and the top cover in such a manner so as to provide a combined pivoting movement and sliding movement of a rear edge of one of said top cover and said base on the other of said top cover and said base during opening and closing of said case, wherein said spring hinge includes:

a first retainer connected with said one of said top cover and said base;

a second retainer connected with said other of said top cover and said base; and a C-clip having a first end connected with said first retainer and a second end connected with said second retainer.

2. A case according to claim 1, wherein said first retainer is integrally formed as a one-piece structure with said one of said top cover and said base, and said second retainer is integrally formed as a one-piece structure with said other of said top cover and said base.

3. A case according to claim 1, wherein said first retainer has a first height and said second retainer has a second height, with said second height being less than said first height such that said rear edge of said one of said top cover and said base moves forwardly in said sliding movement on said other of said top cover and said base during opening of said case and moves rearwardly in said sliding movement on said other of said top cover and said base during closing of said case.

4. A case according to claim 3, wherein said first retainer has a first thickness at a position where the C-clip attaches thereto and said second retainer has a second thickness at a portion where the C-clip attaches thereto, the second thickness being greater than the first thickness, so that the one of the top cover and base slides and pivots on said other of the top cover and the base.

5. A case according to claim 1, wherein said first retainer has a first thickness at a position where the C-clip attaches thereto and said second retainer has a second thickness at a portion where the C-clip attaches thereto, the second thickness being greater than the first thickness, so that the one of the top cover and base slides and pivots on said other of the top cover and the base.

6. A case according to claim 1, wherein said first retainer has a first height and said second retainer has a second height, with said first and second heights being substantially equal.

7. A case according to claim 1, wherein:

said peripheral side wall of said top cover includes a lower exposed surface and a rear portion with a first slot extending in said rear portion through said lower exposed surface;

said peripheral side wall of said base includes an upper exposed surface and a rear portion with a second slot extending in said rear portion through said upper exposed surface;

said first retainer is mounted in one of said first and second slots; and said second retainer is mounted in the other of said first and second slots.

8. A case according to claim 7, wherein said second retainer includes at least one stop that extends beyond the exposed surface of said other of said top cover and said base for limiting forward sliding movement of said one of said top cover and said base on said other of said top cover and said base during opening of said case.

9. A case according to claim 8, wherein said first retainer includes an extending section that extends beyond the exposed surface of said one of said top cover and said base, and said extending section extends into said second slot in said other of said top cover and said base when the case is closed and said at least one stop extends into said first slot in said one of said top cover and said base when the case is closed.

10. A case according to claim 7, wherein said rear portion of said top cover includes an opening in an inner surface thereof which provides communication between the cavity and the respective one of said first and second slots, and said base includes an opening in an inner surface thereof which provides communication between the cavity and the respective other one of said first and second slots.

11. A case according to claim 1, wherein each said retainer includes a central section and first and second end sections connected at opposite ends of said central section, said central section of said first retainer has a first height and said central section of said second retainer has a second height, with said first and second heights being different and said C-clip being connected between the central sections of said first and second retainers such that said rear edge of said one of said top cover and base connected with the retainer having a greater height moves forwardly in said sliding movement on said other of said top cover and base during opening of said case and moves rearwardly in said sliding movement on said other of said top cover and base during closing of said case.

12. A case according to claim 1, wherein each said retainer includes a central section and first and second end sections connected at opposite ends of said central section, said central section of said first retainer has a first height and said central section of said second retainer has a second height, with said first and second heights being substantially equal and said C-clip being connected between the central sections of said first and second retainers.

13. A case according to claim 1, wherein said C-clip has an arcuate shape with inturned ends for engaging said first and second retainers.

14. A case according to claim 1, wherein said first retainer is connected with said top cover and said second retainer is connected with said base.

15. A case according to claim 1, wherein:

said first retainer has a first height and a first thickness at a position where the C-clip attaches thereto, said second retainer has a second height and a second thickness at a portion where the C-clip attaches thereto, and at least one of the following conditions exists so that said top cover pivots and slides on said base during opening and closing operations of said case:

said second height is less than said first height, and said second thickness is greater than said first thickness.

* * * * *